US009949894B2

(12) United States Patent
Puglisi

(10) Patent No.: US 9,949,894 B2
(45) Date of Patent: Apr. 24, 2018

(54) TRANSPORTABLE AND SURFACE-MOUNTING SYSTEM FOR AN AUTO-INJECTION CASE

(71) Applicant: Gregory Puglisi, Dix Hills, NY (US)

(72) Inventor: Gregory Puglisi, Dix Hills, NY (US)

( * ) Notice: Subject to any disclaimer, the term of this patent is extended or adjusted under 35 U.S.C. 154(b) by 264 days.

(21) Appl. No.: 14/722,789

(22) Filed: May 27, 2015

(65) Prior Publication Data

US 2015/0257976 A1 Sep. 17, 2015

Related U.S. Application Data

(62) Division of application No. 13/608,441, filed on Sep. 10, 2012, now abandoned.

(60) Provisional application No. 61/536,888, filed on Sep. 20, 2011.

(51) Int. Cl.

| | |
|---|---|
| ***B65D 69/00*** | (2006.01) |
| ***A61J 1/16*** | (2006.01) |
| ***A45F 5/02*** | (2006.01) |

(52) U.S. Cl.

CPC ..... *A61J 1/16* (2013.01); *A45F 5/02* (2013.01); *A45C 2200/05* (2013.01); *A45F 2200/0566* (2013.01)

(58) Field of Classification Search

CPC ..... A45F 5/02; A45F 2200/0566; A45C 2200/05; A45C 13/126; A61J 1/16

USPC ..... 206/232, 364, 366, 438, 459.5, 806, 206/459.1; 220/480, 481, 737–739; 116/321

See application file for complete search history.

(56) References Cited

U.S. PATENT DOCUMENTS

| | | | | |
|---|---|---|---|---|
| 2,740,516 | A * | 4/1956 | Renn | A61M 5/003 206/229 |
| 3,089,590 | A | 5/1963 | Mell | 206/78 |
| 3,161,288 | A | 12/1964 | Wagner | 206/45.31 |
| 3,796,304 | A | 3/1974 | Blais | 206/328 |
| 4,051,992 | A | 10/1977 | Bergstein | 229/21 |
| 4,174,038 | A | 11/1979 | Whiting, Jr. | 206/389 |
| 4,454,979 | A | 6/1984 | Ikeda et al. | 229/52 B |
| 4,640,413 | A * | 2/1987 | Kaplan | B65D 85/546 206/232 |
| 5,016,752 | A * | 5/1991 | Haugen, Jr. | B42F 7/14 206/232 |

(Continued)

FOREIGN PATENT DOCUMENTS

| | | | |
|---|---|---|---|
| WO | WO 2001/006481 | 1/2001 | G09B 21/00 |
| WO | WO 2003/072011 | 9/2003 | A61J 1/03 |

*Primary Examiner* — Luan K Bui

(74) *Attorney, Agent, or Firm* — Bodner & O'Rourke, LLP; Gerald T. Bodner; Christian P. Bodner

(57) ABSTRACT

An auto-injection device holder includes a main body having at least a front wall, a back wall and a bottom wall, and an open top. The walls define a cavity for receiving at least partially therein at least one auto-injection device. An electrical circuit is mounted to the main body to provide information to a user of the auto-injection device holder. A switch is mounted on a wall of the main body and may be pressed by a user of the holder. The electrical circuit includes a read only memory having pertinent information stored digitally therein. When the switch is activated, the information stored digitally in the read only memory is converted to an analog signal which is provided to the speaker so that the user may hear the pertinent information, such as instructions on how to use the auto-injection device held by the holder.

8 Claims, 11 Drawing Sheets

(56) References Cited

U.S. PATENT DOCUMENTS

| | | | | |
|---|---|---|---|---|
| 5,407,094 | A * | 4/1995 | Vajtay | A47F 1/08 221/155 |
| 5,492,616 | A | 2/1996 | Cook et al. | 206/591 |
| 5,950,827 | A | 9/1999 | Odom et al. | 206/364 |
| 6,173,515 | B1 | 1/2001 | Walsh | 40/124.08 |
| 6,279,743 | B1 * | 8/2001 | Ballard | A61M 5/3213 128/852 |
| 6,595,362 | B2 | 7/2003 | Penney et al. | 206/364 |
| 6,845,583 | B2 * | 1/2005 | Lee | G09F 25/00 40/124.03 |
| 7,036,664 | B2 * | 5/2006 | Lee | B65D 75/366 206/1.5 |
| 7,311,205 | B2 * | 12/2007 | Adler | B65D 1/0223 206/459.5 |
| 7,434,686 | B2 | 10/2008 | Prindle | 206/364 |
| 2011/0247963 | A1 | 10/2011 | Stockett | 206/572 |

* cited by examiner

TRANSPORTABLE AND SURFACE-MOUNTING SYSTEM FOR AN AUTO-INJECTION CASE

CROSS-REFERENCE TO RELATED APPLICATIONS

This application is a divisional of U.S. patent application Ser. No. 13/608,441, filed on Sep. 10, 2012, and entitled "Transportable and Surface-Mounting System for an Auto-Injection Case", which claims the benefit of priority under 35 U.S.C. 119 and/or 35 U.S.C. 120 to U.S. Provisional Application Ser. No. 61/536,888, which was filed on Sep. 20, 2011, and is entitled "Transportable and Surface-Mounting System for an Auto-Injection Case", the disclosure of each of which is hereby incorporated by reference and on which priority is hereby claimed.

BACKGROUND OF THE INVENTION

Field of the Invention

The present invention relates to devices and systems for the storage and transportation of auto-injection devices.

Description of the Related Art

Anaphylaxis is a severe allergic reaction that is rapid in onset and can be life-threatening Anaphylaxis can be triggered by a variety of substances including foods, medications, latex, and bee venom, but can also occur in the absence of allergens, for example, during physical exercise, or even with no known trigger. Because these and other sources of allergy are prevalent in everyday life, one who is at risk cannot predict when they may come in contact with a potential trigger. When anaphylaxis occurs, it typically is very rapid in onset and requires immediate treatment to help reverse or abort the allergic reaction. As a result, many people with known allergies must have the appropriate medication readily available at all times.

In order to treat anaphylaxis, many allergy sufferers utilize a device that enables them to quickly administer an appropriate medication, such as epinephrine. These devices are commonly referred to as "auto-injection devices" or "auto-injectors", and are exemplified by the injector sold by DEY L.P., under the trademark EpiPen®. Auto-injection devices generally contain one or two doses of epinephrine and include a needle for quickly injecting the medication intramuscularly. In most cases, it is recommended that individuals at risk for anaphylaxis have an auto-injection device readily available at all times.

There are several difficulties associated with the storage of auto-injector devices. For example, the medicament contained within the device must be properly stored, timely administered, and have its efficacy maintained. First, an auto-injector device, such as the EpiPen® device, is approximately the size of a large magic marker, and can be easily misplaced, leading to a delay in the treatment of a reaction. Second, delivery of medicament from an auto-injector must be immediate, and specific instructions must be followed to ensure proper delivery of the medicament at the time of an anaphylactic reaction. Third, users must guard against the medicament within the device from becoming less efficacious, and therefore, potentially ineffective at the time of use. Loss of efficacy can occur with exposure to UV light, temperature extremes, and use of the device after the expiration date. A delay in use, improper use of the auto-injector, or loss of medication efficacy, may lead to worsening of an allergic reaction, and is a risk factor for worsening anaphylaxis, and increases the risk of death.

In response to some of the above issues, several protective cases have been developed for carrying auto-injection devices while shielding them from both mechanical forces and UV radiation, such as is disclosed in U.S. Pat. No. 6,595,362 (Penney, et al.) and U.S. Pat. No. 5,950,827 (Odom, et al.). Each patent discloses a case that surrounds and completely encloses an auto-injection device, protecting the device from damage and completely shielding it from light. Both types of cases are of appropriate size and can be easily carried by a user, for example, in a typical pants pocket.

While some protective cases for auto-injection devices, such as those disclosed by the Odom, et al. and Penney, et al. patents, have alleviated some of the problems associated with the storage of such a device, other difficulties persist. For example, in places visited regularly, such as a home or office, such cases are often stored out of view, in pockets or drawers, making them easily forgotten when traveling and difficult to locate in times of urgent need. This latter issue is highlighted in situations where the device user, who is often most capable of locating the device, is suffering an anaphylactic reaction and unable either to self-medicate or to describe the device location. In addition, these types of cases are intended to replace the existing carrying cases, thereby concealing the recognizable auto-injection device. This potentially delays the ability of a bystander to locate the device for individuals undergoing a reaction, and unable to communicate because of age or the reaction itself.

More recently, U.S. Pat. No. 7,434,686 (Prindle) addresses some of these problems by disclosing a storage system for auto-injection devices that holds the devices at a location where anaphylaxis is more likely to occur or where an allergy sufferer is frequently found. Such a system could be used in place of, or in addition to, having each individual sufferer carry a device everywhere with him/her, and would hold devices ready at critical locations, such as a home or office, restaurants, malls, and schools.

While conventional storage systems for auto-injection devices, such as the one disclosed by the Prindle patent, have alleviated some of the problems associated with each individual sufferer having to carry a device everywhere with him/her, and having devices ready at critical locations, other difficulties persist. For example, the storage system disclosed by the Prindle patent maintains the auto-injection device in a fixed location, as the device requires screws to support it on a flat surface. Therefore, the convenience for allergy sufferers to be able to easily move the device to another location is lost with use of the Prindle storage system. The Prindle patent also teaches complete enclosure of the auto-injection device, which creates the potential for an allergy sufferer or care provider not to recognize that an auto-injection device is present within the storage unit. Further, because the Prindle storage system is completely enclosed, it requires the user to open the storage unit in order to access the device. This could potentially delay access to the auto-injection device if one undergoing a reaction or a care provider is not familiar with its proper use or if the opening device malfunctions.

OBJECTS AND SUMMARY OF THE INVENTION

An object of the present invention is to provide a surface-mounting system for auto-injectors that enables a user to store an auto-injection device(s), shielding the medicament within the device from UV light, but at the same time not concealing the device, and providing unobstructed access to the auto-injector(s), thereby making it easily recognizable and quickly located and accessed in times of need.

It is another object of the present invention to provide a system that enables the auto-injection device to be highly visible, thereby significantly reducing the potential for an allergy sufferer or care provider to not even recognize that an auto-injection device is present.

It is still another object of the present invention to provide an audio prompting circuit mounted to a housing or case for an auto-injector which can be activated to play a recording that contains vital information such as instructions for proper use of the auto-injector(s) contained within the case.

In accordance with one embodiment of the present invention, a case or holder is provided for temporarily mounting an auto-injector to a surface without concealing the auto-injector. The case includes a main body having a front wall and an opposite back wall, a cavity defined by and between the front and back walls, and a bottom wall. The back wall contains a mounting strip fixed to an exterior surface of the back wall for temporarily or permanently mounting the case to a supporting wall or other surface, such as the front or side of a refrigerator. The strip may be a Velcro™ hook and loop fastener, which releasably engages a mating Velcro™ fastener mounted on the wall or surface. Or, for example, the mounting strip may be a magnetic structure for mounting the case or holder to a metal surface, such as a refrigerator or other appliance. The back wall may contain holes, allowing the case to be fixed to a wall by nails or screws.

The front wall contains a surface to display vital information, such as name and emergency contacts and/or information describing the proper use of the auto-injector contained within the case. In addition, an indicator of the auto-injector expiration date can be contained within or mounted on the front wall of the case. Furthermore, the bottom wall of the case preferably incorporates an electrical circuit that can be activated to provide pre-recorded vital information such as instructions for proper use of the auto-injector(s) contained within the case.

In accordance with another embodiment of the present invention, a case is provided for temporarily mounting one or more auto-injectors to an article of clothing. The case, which may be made of a soft material, includes a front wall and opposite back wall, and a pair of lateral side walls extending between the front and back walls to form therewith a cavity for receiving and removably holding the auto-injectors. The back wall includes a mounting clip fixed to the exterior surface of the back wall for mounting the case or holder to an article of clothing. The front wall may include a space for displaying vital information, such as name and emergency contacts and/or information describing the proper use of the auto-injector contained within the case. In addition, an indicator of the auto-injector expiration date may be mounted on the front wall or a lateral side wall of the case. Preferably housed within the cavity of the case is an electrical circuit which can be activated to play a recording that contains vital information such as instructions for proper use of the auto-injector(s) contained within the case.

In accordance with yet another embodiment of the present invention, a holder is provided for housing a pair of auto-injector devices. The holder includes either front and back walls, or a single hollow tubular member. The front and back walls or single hollow tubular member defines an orifice, which receives a portion of the outer casing of at least one auto-injector device. The holder may further include an electrical circuit which can be activated to play a recording that contains vital information such as instructions for proper use of the auto-injector(s) contained within the holder.

In accordance with still another embodiment of the present invention, a holder of an auto-injector device has a tubular member and a cap releasably mounted on the tubular member on an open end thereof. The holder may further include an electrical circuit which can be activated by opening the cap of the holder which plays a recording that contains vital information such as instructions for proper use of the auto-injector(s) contained within the holder.

In accordance with a further embodiment of the present invention, a display board containing vital information such as instructions for proper use of an auto-injector is outfitted with an audio system which can be activated by opening the cap of the holder which plays a recording that contains vital information such as instructions for proper use of an auto-injector.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 2:
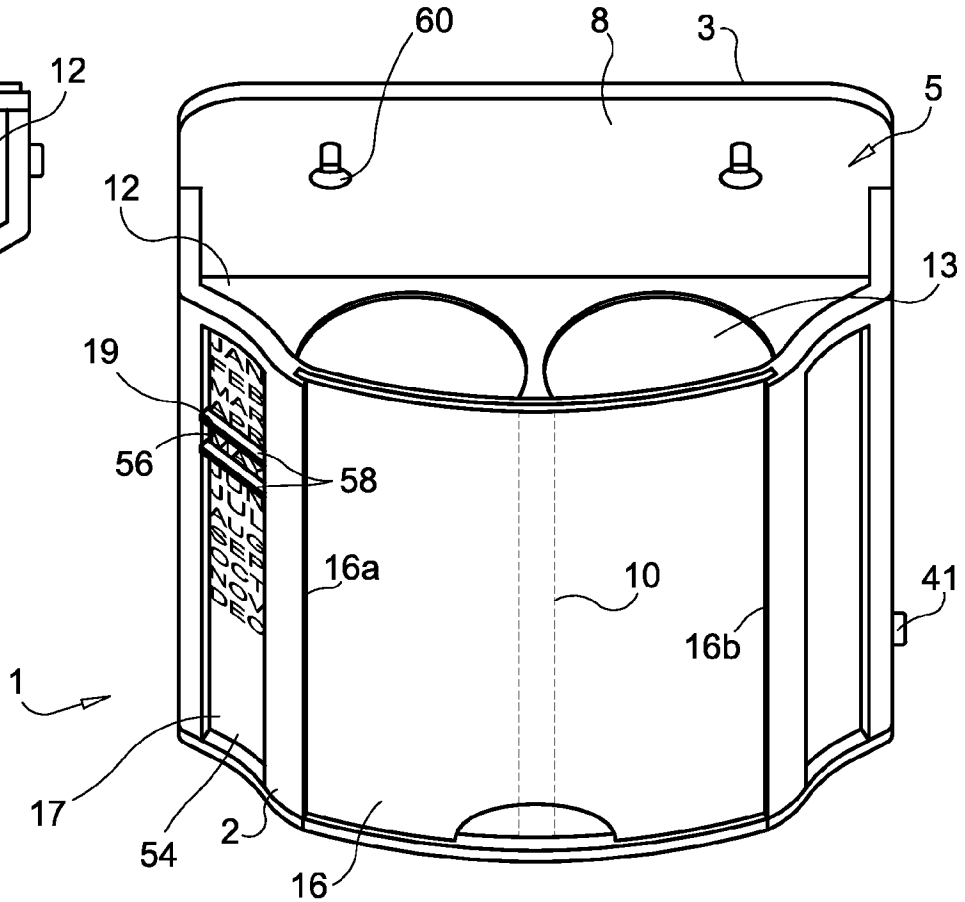
FIG. 2 is a front isometric view of the first embodiment of a device of the present invention.
Figure 1:
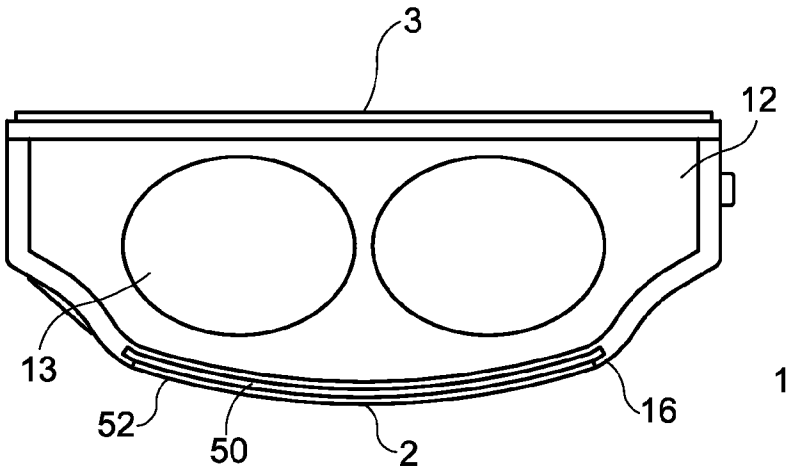
FIG. 1 is a top plan view of a first embodiment of a device of the present invention.
Figure 4:
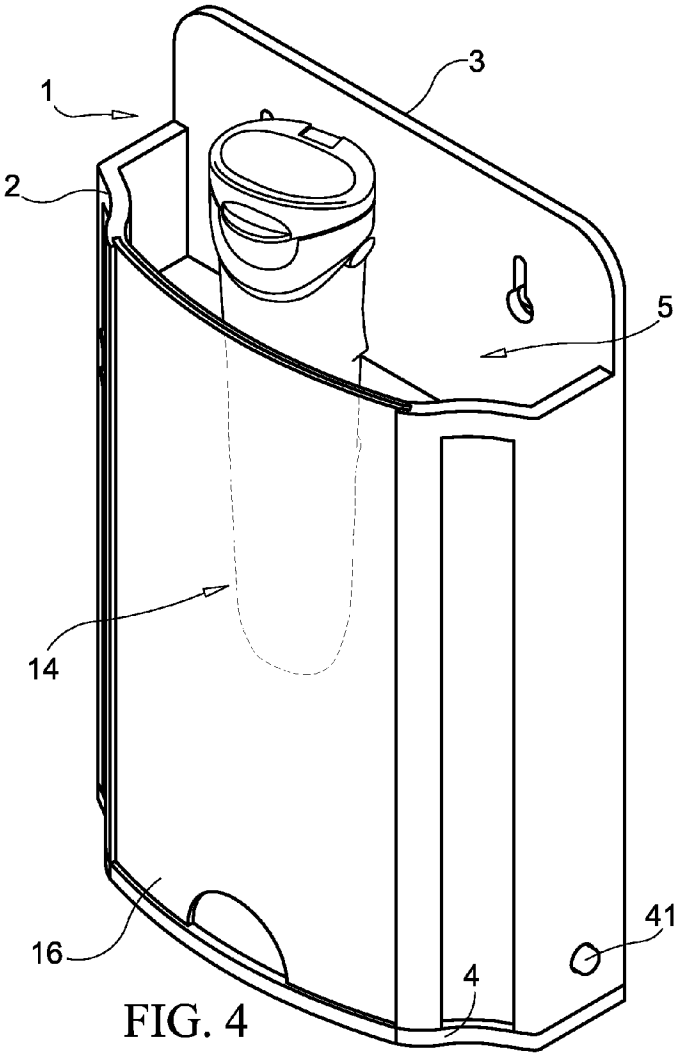
FIG. 4 is front left perspective view of the first embodiment of a device of the present invention.

In accordance with a first embodiment of the present invention, as shown in FIGS. 1-5, a case or holder 1 is provided for housing at least one auto-injector device. In a preferred embodiment, the case 1 includes a main body having a front wall 2, an oppositely disposed back wall 3, and a bottom wall 4 affixed to the front wall and back wall of the case.

The front wall 2 is preferably generally convex in shape. More specifically, the front wall 2 extends generally axially outwardly from a front surface of the back wall 3 to define with the back wall 3 and bottom wall 4 a cavity 5 to receive and store at least one auto-injector device. The cavity 5 has preferably a generally trapezoidal shape when viewed from the top of the case 1, as shown in FIG. 2.

Figure 6:
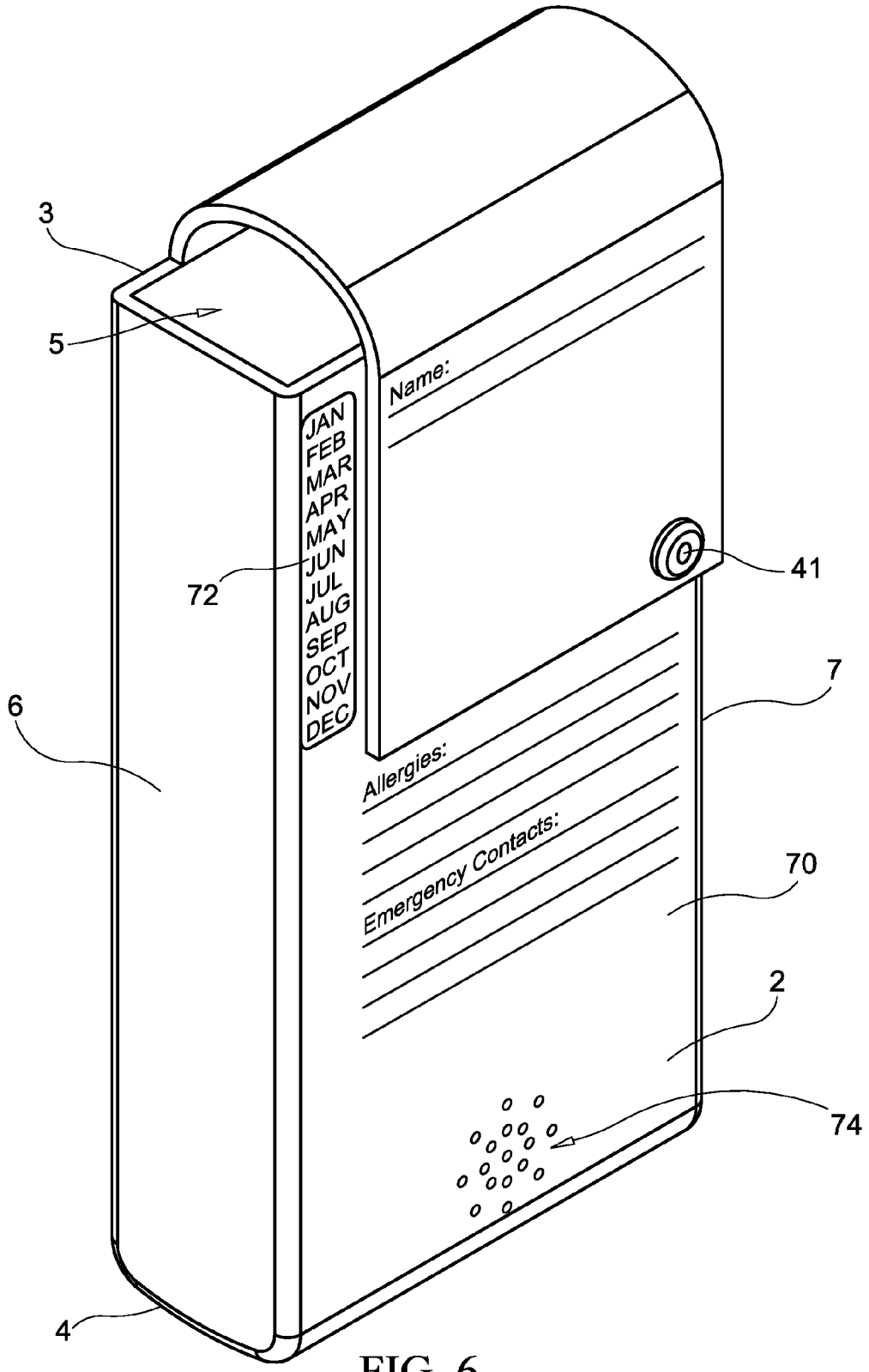
FIG. 6 is front right perspective view of a second embodiment of a device of the present invention.
Figure 7:
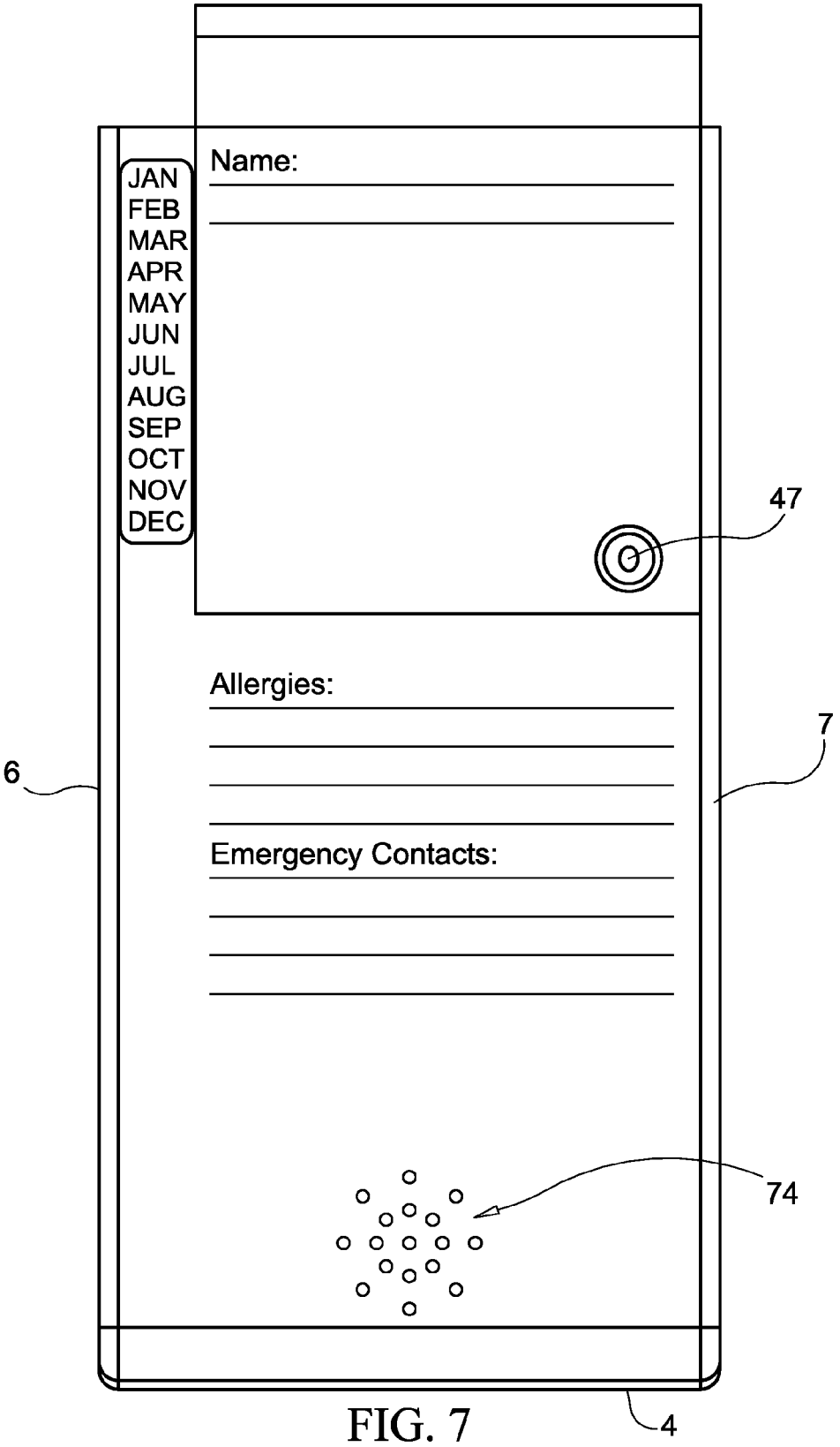
FIG. 7 is front elevational view of the second embodiment of a device of the present invention.

In a second embodiment shown in FIGS. 6-10, which is one that may be worn by a user, the front and back walls 2,3 are joined by left and right lateral walls 6,7 to form the cavity 5, as shown in FIG. 6. The left and right lateral walls 6,7 extend parallel to each other and between the front and back walls 2,3. The left and right lateral walls 6,7 are also joined to the bottom wall 4 at one end thereof, similar to the front and back walls 2,3 of the holder shown in FIG. 3. The cavity 5 in this second embodiment of FIGS. 6-10 has an overall rectangular shape. The walls 2, 3, 4, 6, 7 are preferably formed from a flexible or soft material, such as leather or vinyl, so that the holder may be comfortably worn by a user and affixed to his belt or other portion of his clothing.

In the wearable embodiment of the holder shown in FIGS. 6-10, a portion of the back wall 3 extends beyond the vertical length of the front wall 2 such that a portion of the back wall 3 defines a flap that can be folded over a portion of the front wall 2 and may be releasably secured thereto by mating Velcro™ hook and loop fasteners affixed to the front and back walls 2, 3, snaps 41, or other fasteners, to selectively cover and uncover a top opening of the cavity 5 so that the auto-injector may be removed therefrom.

Returning to the first embodiment, and as shown in FIG. 2, a separator wall 10 may be situated in the cavity 5 of the holder or case 1 between the front and back walls 2,3 and along at least a portion of the height of the walls 2,3. The separator wall 10 is provided to physically separate multiple auto-injectors housed within the cavity 5. This separator wall 10 may be included in the wall-mountable holder of FIGS. 1-5 or the wearable holder of FIGS. 6-10.

Again returning to the first embodiment shown in FIGS. 1-5, it will be seen that the case 1 may also include a top wall 12. The top wall 12 extends between the front wall 2 and the back wall 3, and is situated opposite the bottom wall 4. The top wall 12 includes at least one opening 13 extending through its thickness. The opening 13 is of a size and shape to allow it to receive removably a portion of the outer casing 14 of an auto-injector device. The overall depth of the holder 1 measured from the bottom wall 4 to the top wall 12 is preferably such that the auto-injector device projects outwardly from the opening 13 in the top wall 12 so that it may be quickly and easily grasped by a user in an emergency situation. A similarly structured top wall 12, with one or more device-receiving openings 13, may be included in the wearable holder of FIGS. 6-10, as well.

In the first embodiment of the holder shown in FIG. 2 of the drawings, the front surface of the front wall 2 is cut away in two places to form a front recessed portion 16 and a second, side recessed portion or slot 17. The front recessed portion 16 is defined by two opposite, lateral slots 16*a* and 16*b*. The slots 16*a* and 16*b* are provided to receive a flexible information sheet 50 (see FIG. 1) on which is contained important information, such as the patient's name, emergency contact information, and instructions for using the auto-injector held by the case 1. The information sheet 50 is removably held in place on the front wall 2 of the holder 1 by having its opposite lateral edges received by the slots 16*a* and 16*b*. A transparent, plastic film or sheet 52 (see FIG. 1) may be placed in front of the information sheet 50 and situated at its lateral edges within slots 16*a* and 16*b* to provide protection for the information sheet 50.

The second, side recessed portion or slot 17 also includes an information sheet 54 removably or fixedly mounted therein with preferably the months of the year in descending order printed thereon. An indicator piece 19 is held in place in slot 17 and is slidable along the length thereof. The indicator piece 19 is rectangular in shape, and includes a rectangular viewing opening 56 situated at its center and between two parallel bars 58. The rectangular opening 56 is dimensioned to be of sufficient size to display at least a portion of the month (or an abbreviation of the month) printed on the information sheet 54 within slot 17.

The purpose of the months printed on the information sheet 54 is to remind the user when the auto-injector held by the case 1 has reached its expiration date and must be replaced. The user may slide the indicator piece 19 along the length of slot 17 and position the indicator piece 19 so that the replacement month of the auto-injector (e.g., March) is visible to the user through the rectangular opening 56 of the indicator piece 19.

In the wearable version of the holder shown in FIGS. 6-10, a similarly structured front recessed portion 16 and side recessed portion or slot 17 may be formed respectively in the front wall 2 and lateral walls 6, 7. Alternatively, the front wall 2 may include a first information sheet 70 having an adhesive backing that is removably affixed to the front wall 2 and has lines and spaces to write important information thereon, such as an identification of the particular allergies that afflict the user, or emergency contact information. A second information sheet 72, also with an adhesive backing, may be removably affixed to an outer surface of the holder, such as the front wall 2 or one of the lateral walls 6, 7, with the months of the year or abbreviations thereof which the user may mark or circle to indicate the month the auto-injector devices expire and need to be replaced.

Figure 3:
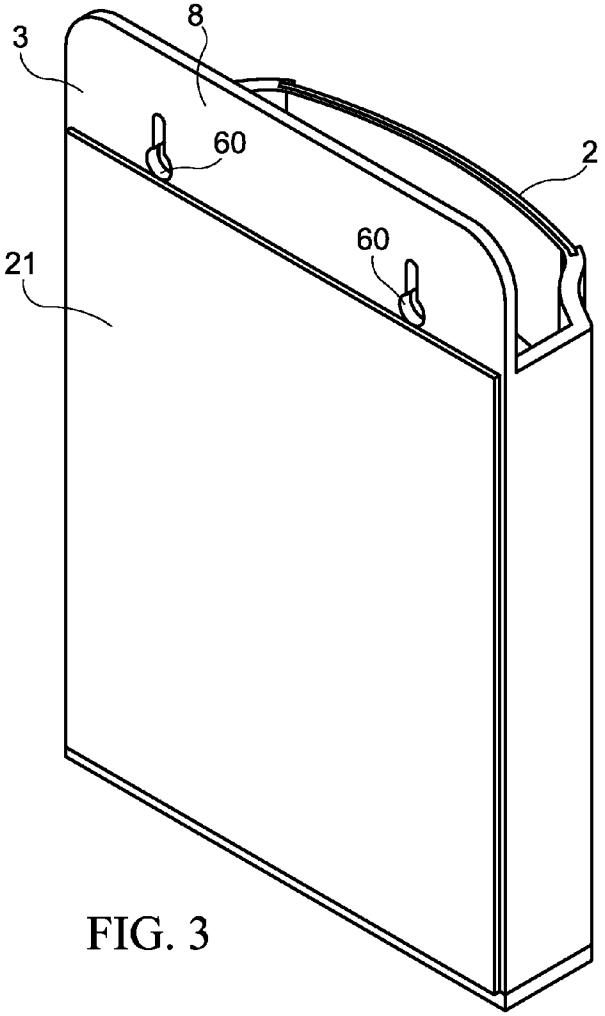
FIG. 3 is rear right perspective view of the first embodiment of a device of the present invention.
Figure 5:
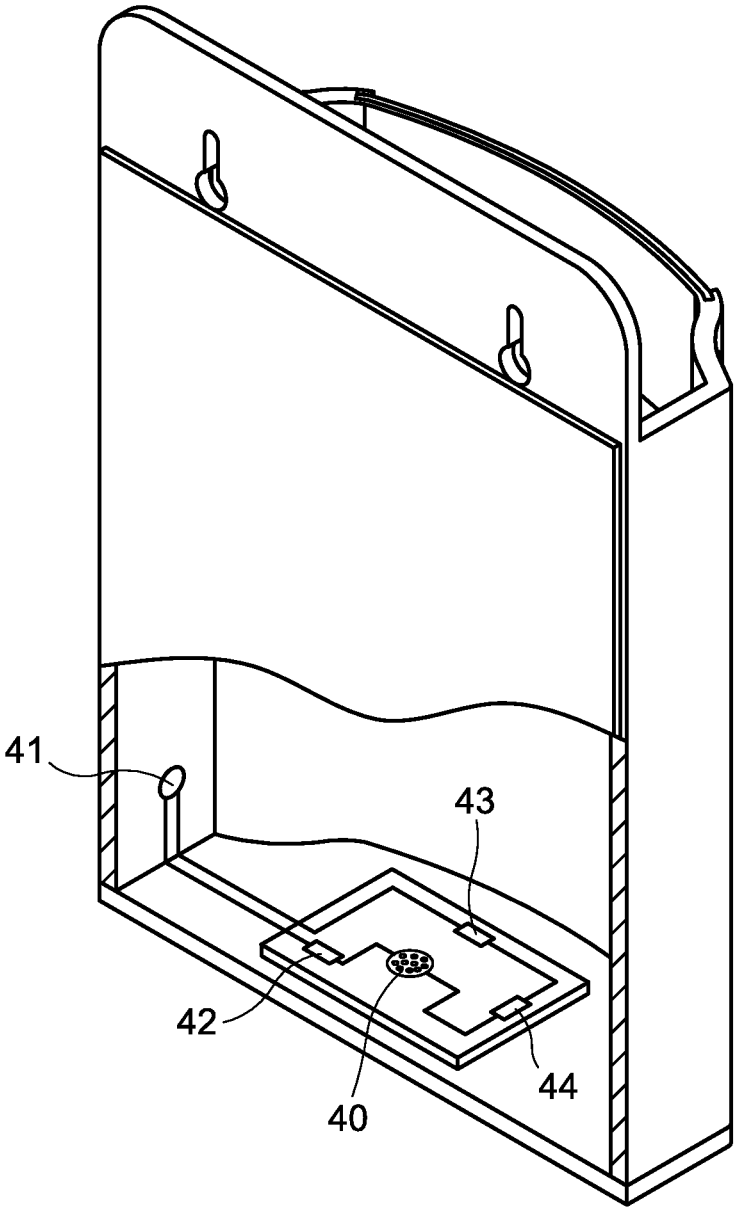
FIG. 5 is a rear right elevational view of the first embodiment of a device of the present invention, with a cutaway section.

The auto-injector holder 1 of the present invention may be secured or mounted to a stationary surface or, as shown in the embodiment of FIGS. 6-10, may be worn by a person on his belt. With respect to the embodiment of the holder shown in FIGS. 1-5, in order to secure or mount the holder 1 to a stationary surface, the outside surface of the back wall 3 may contain a mounting fastener 21. The mounting fastener 21 can be an adhesive tape, a magnet, Velcro™ hook and loop fastener, a snap, or any other type of fastener or fastening material that is adapted to adhere to a stationary surface and support the weight of the holder 1. Alternatively, a portion of the back wall 3 of the holder preferably extends beyond the vertical length of the front wall 2 to define a mounting flange 8, as shown in FIGS. 2 and 3. The flange 8 of the holder 1 may include one or more openings 60 formed through the thickness thereof, such as key hole openings, to receive a screw, nail or hook to allow the holder 1 to be secured or mounted to a supporting wall or surface.

Figure 8:
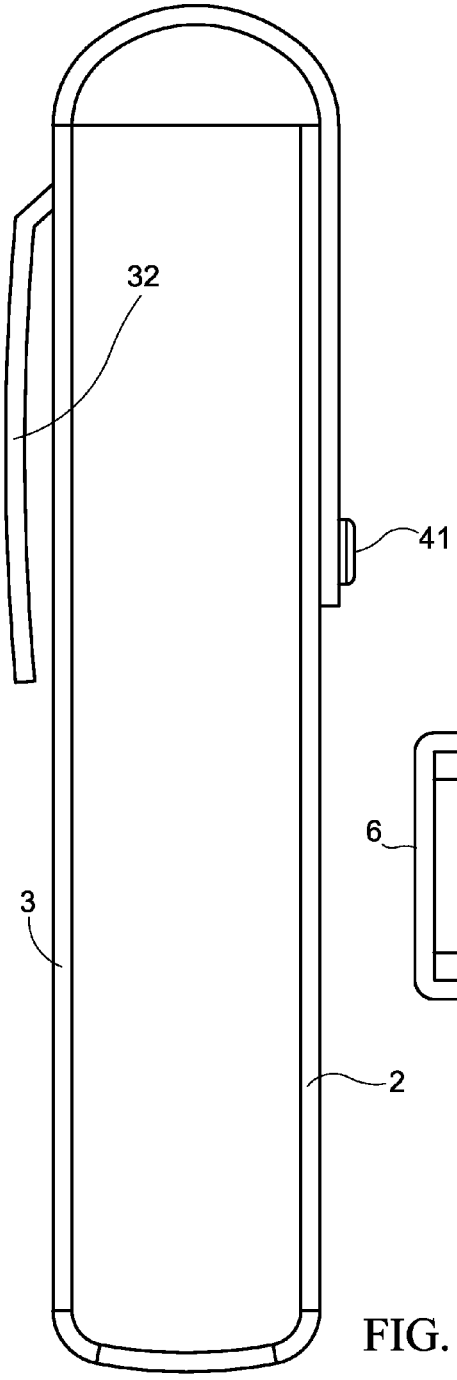
FIG. 8 is a right elevational view of the second embodiment of a device of the present invention.
Figure 9:
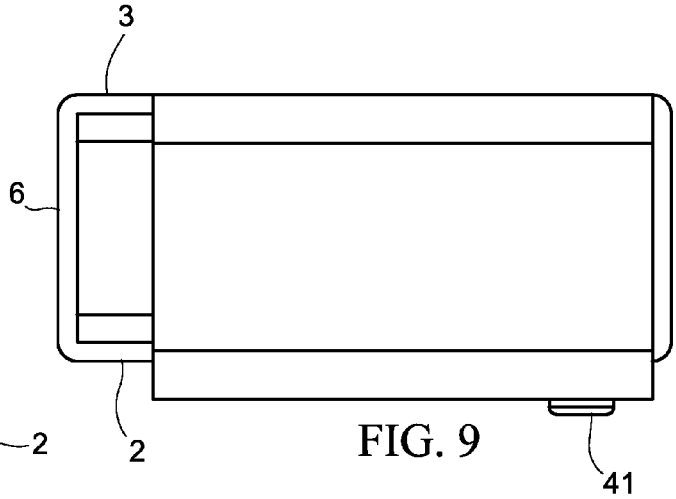
FIG. 9 is a top plan view of the second embodiment of a device of the present invention.
Figure 10:
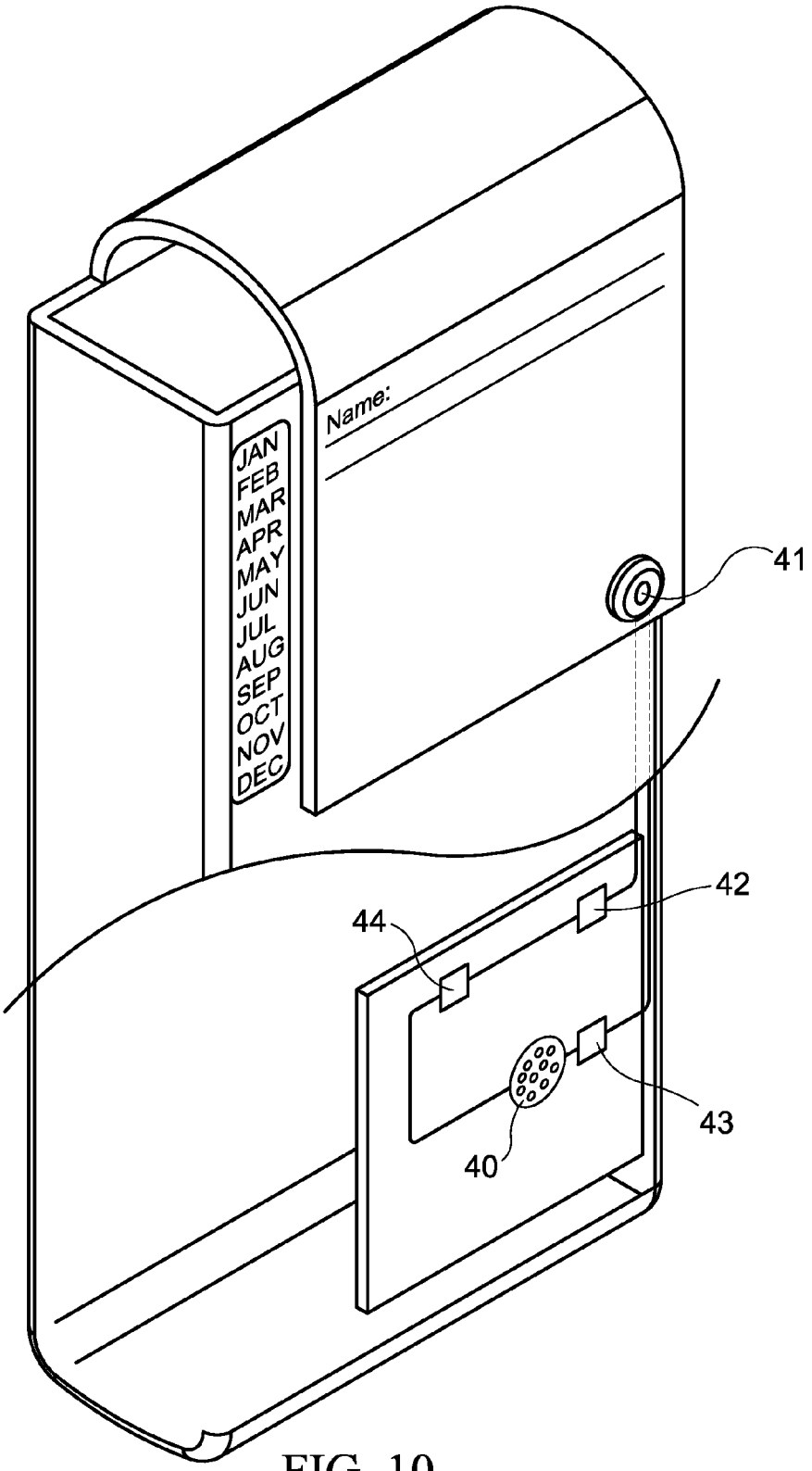
FIG. 10 is a front right elevational view of the second embodiment of a device of the present invention, with a cutaway section.

In yet another embodiment of the present invention, the wearable holder may include a clip 32, as shown in FIG. 8, which extends from the outside surface of the back wall 3 to allow a wearer to attach the holder 1 to an article of clothing, such as a belt.

Figure 13:
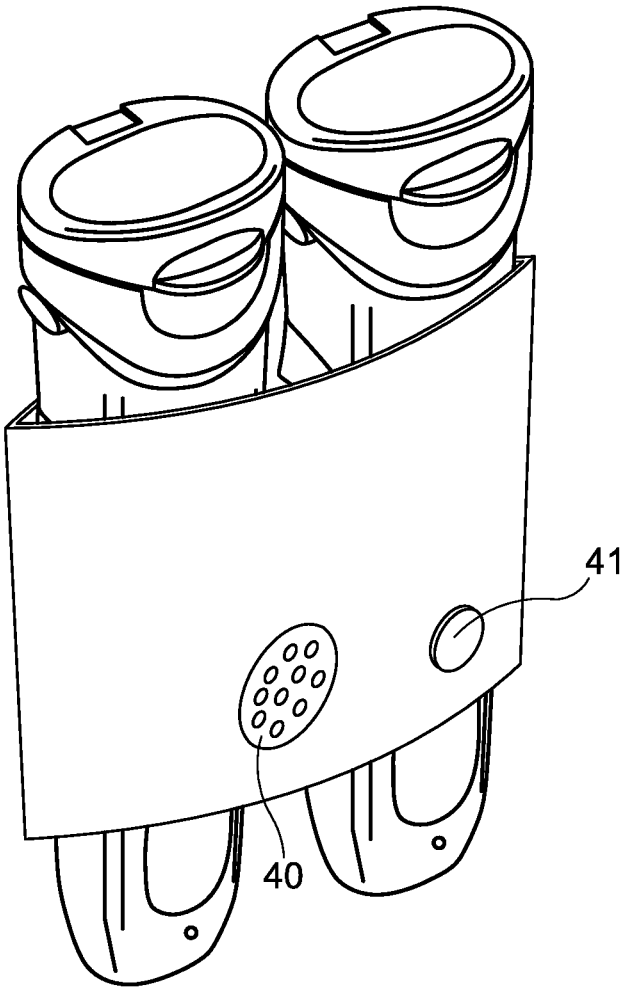
FIG. 13 is front right elevational view of a fourth embodiment of a device of the present invention, and illustrating two auto-injector devices held thereby.
Figure 14:
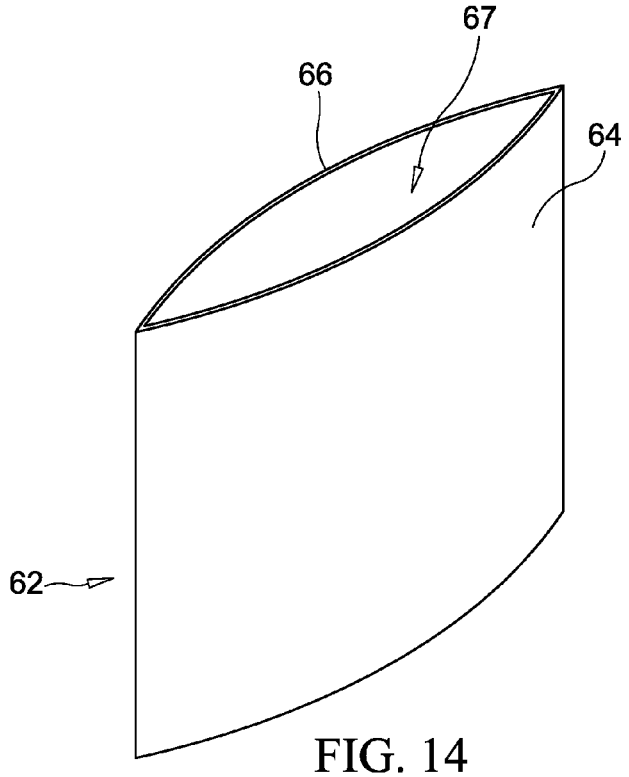
FIG. 14 is a rear elevational view of the fourth embodiment of a device of the present invention.
Figure 15:
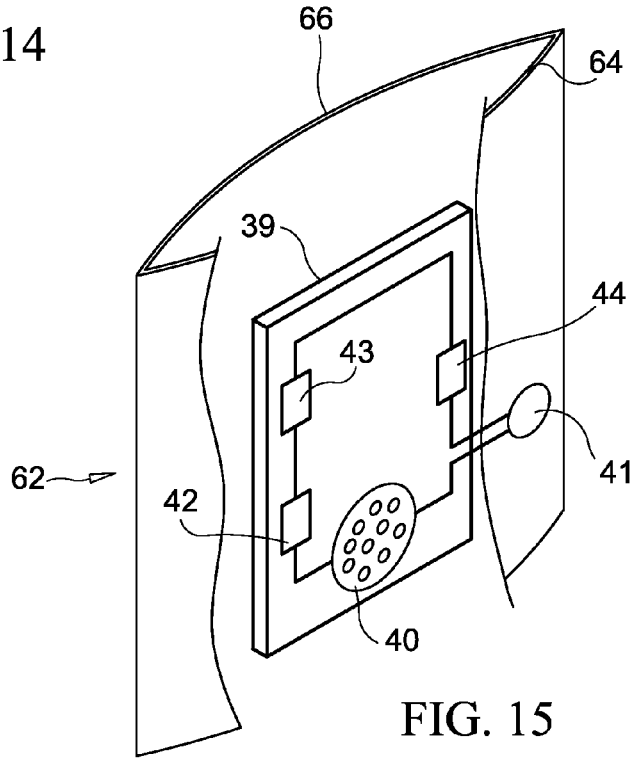
FIG. 15 is another front right elevational view of the fourth embodiment of a device of the present invention, with a cutaway section.

In yet another embodiment of the present invention, and as shown in FIGS. 13, 14 and 15, the holder 1 may be formed as a sleeve which is adapted to surround one or more auto-injector devices and their casings. The sleeve 62 may be formed with a first wall 64 and a second wall 66. The first and second walls 64, 66 are joined together at their lateral edges in such a manner that they bulge outwardly from each other at their centers, thereby defining a cavity 67 for receiving one or more auto-injector devices and their casings securely therein. The front and back walls 64, 66 are formed from a semi-rigid, but resilient, material, such as cardboard, such that the sleeve 62 may be expanded at its center to receive and retain the auto-injector device or devices by squeezing the joined lateral edges of the walls 64, 66 towards one another.

As mentioned previously, each of the embodiments of the holder 1, including the sleeve 62 embodiment, preferably includes an electrical circuit for providing pertinent information to the user, such as an auto-injector ordering information, or directions on how to use the auto-injector. The electrical circuit 39 may include a speaker 40, a switch 41 provided on an exposed surface of the holder 1 (which term includes sleeve 62) for the user to activate the electrical circuit, a read only memory (ROM) 42, a microprocessor 43 and a power source 44, such as a battery. The electrical circuit 39 is preferably mounted within the cavity of the holder. As mentioned previously, the ROM 42 stores an audio recording of instructions on how to use the auto-injection device. The switch 41 is mounted on an exposed surface, such as the outside surface of the side or front wall of the holder 1 (or on one of the first and second walls 64, 66 of the sleeve 62). When the switch 41 is activated, the power source 44 powers the electrical circuit, and the microprocessor 43 causes the recording stored in the ROM 42 to play through the speaker 44 the instructions on how to use the auto-injection device for the user to hear. A plurality of holes 74 may be formed through the thickness of a wall of the holder and which is situated in alignment with the speaker 44, if the speaker is not directly exposed on a wall of the holder.

Figure 11:
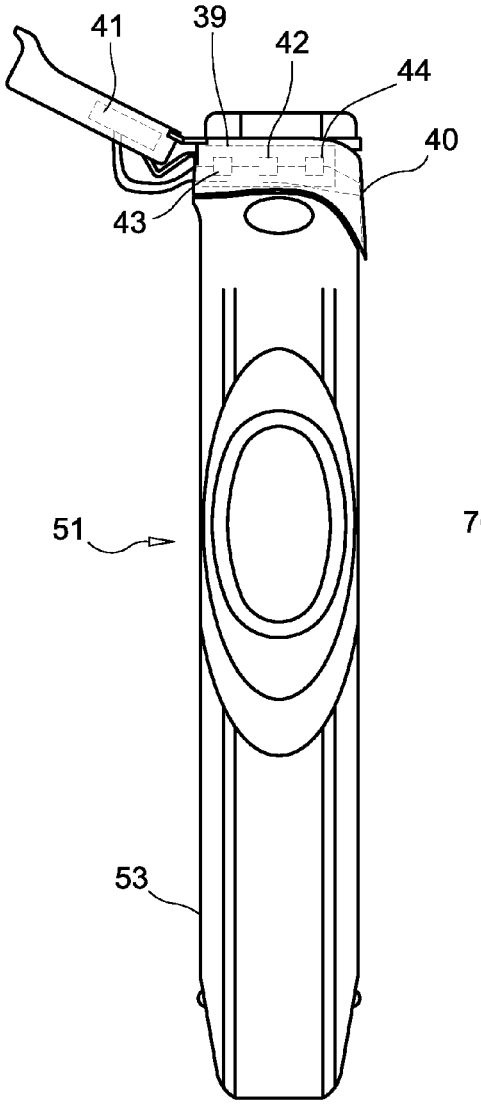
FIG. 11 is right side elevational view of a third embodiment of a device of the present invention.
Figure 12:
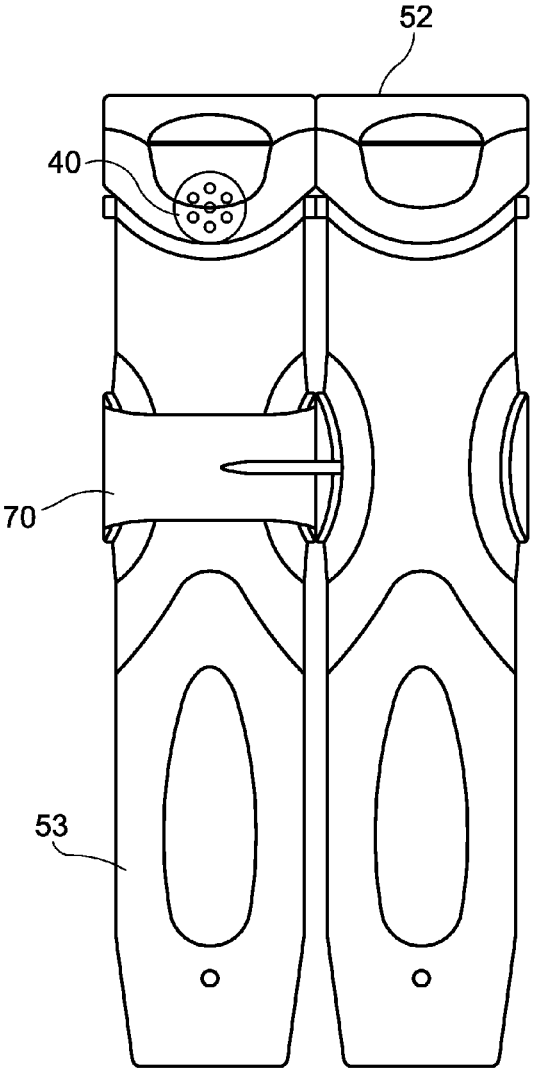
FIG. 12 is front elevational view of the third embodiment of a device of the present invention.

In yet another embodiment of the present invention, shown in FIGS. 11 and 12, the holder 1 may include a protective casing or container 51 for the auto-injector. The container 51 includes a tubular body 53, and a cap 52 mounted on an open end of the tubular body 53. The body 53 includes an electrical circuit 39, such as described previously with respect to the other embodiments, to provide instructions to the user on how to use the auto-injection device held within the container 51. A switch 41 may be mounted on the cap 52 or in the container 51, and is activated when the cap 52 is opened. When activated, the switch 41 causes the electrical circuit 39 to play through a speaker 40 situated within the container 41 instructions for the user to hear on how to use the auto-injection device housed by container 51, or other pertinent information regarding the auto-injector. FIG. 12 merely shows the situation where one or more containers 51 may be held together using an S-clamp 70, as is well known in the art, where one or more of the containers 51 include the electrical circuit 39 for providing pertinent information to the user.

Figure 17:
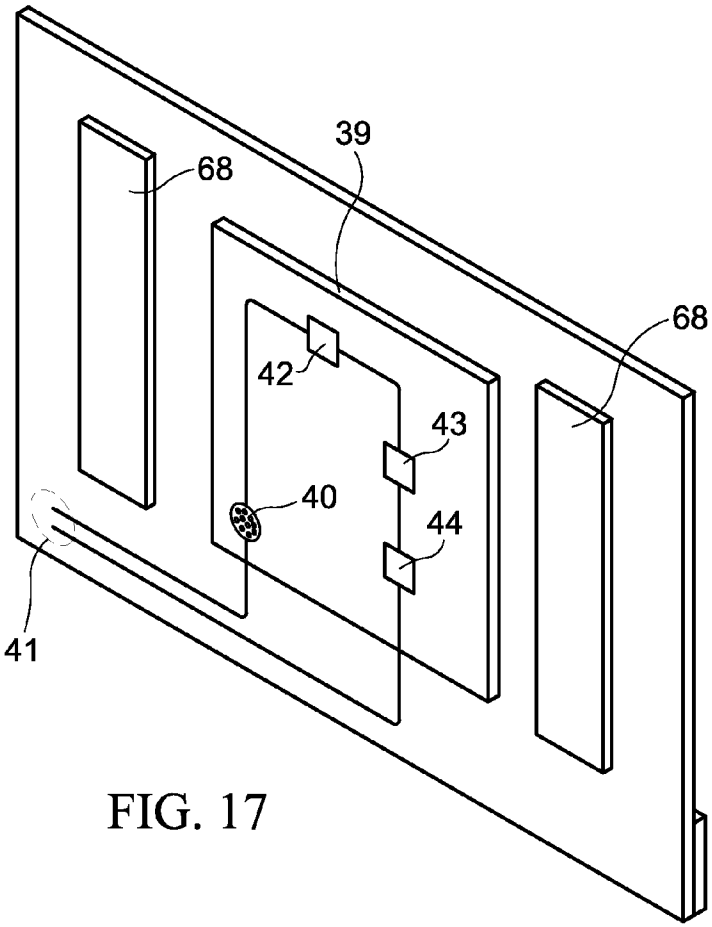
FIG. 17 is a rear right elevational view of the fifth embodiment of a device of the present invention.
Figure 16:
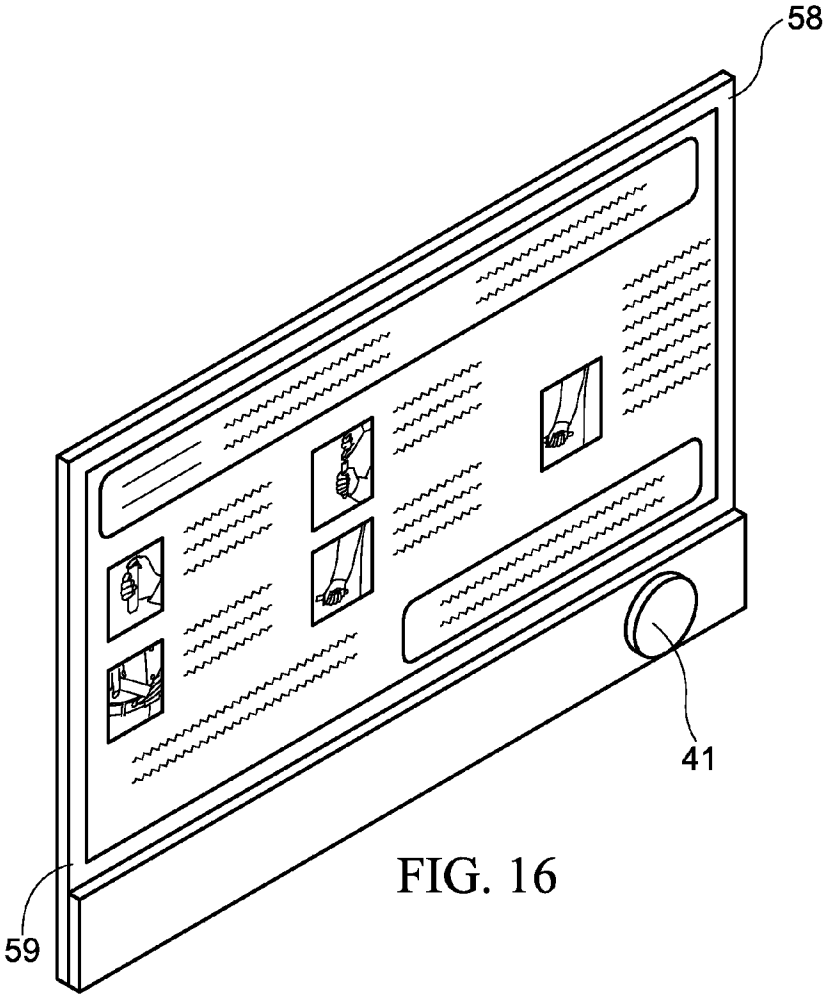
FIG. 16 is a front left elevational view of a fifth embodiment of a device of the present invention.

A fifth embodiment of the present invention is shown in FIGS. 16 and 17. This embodiment is not a holder for an auto-injection device, but rather is a device which is mountable to a refrigerator or another appliance, or to a supporting surface, such as a wall, and provides pertinent information to a user of an auto-injection device in printed form and/or verbally through an electrical circuit 39.

In this embodiment, a planar, rectangular informational member 58 has at least one display surface 59, which can be used to display printed information, such as a patient's name, emergency contact information, the date the medicine in the auto-injector expires, and instructions for using the auto-injector. The display surface 59 can be written on by the user to display information entered by the user. The display surface 59 may have mounted thereon a removable printed sheet containing such information.

The informational member 58 preferably also includes an electrical circuit 39 such as described previously with respect to the other embodiments of the present invention. The electrical circuit 39 is mounted within the informational member 58 or on the rear side thereof On an exposed surface of the informational member 58, such as the front side thereof, there is an activation switch 41, such as a push button switch. The electrical circuit 39 preferably includes the various components described previously, including a speaker 40, a ROM 42, a microprocessor 43, a power source 44 and the activation switch 41, as shown in FIG. 17.

When a user would like to hear verbal instructions as to how to use the auto-injector, he presses switch 41, which activates the electrical circuit. The electrical circuit causes the speaker 40 to play back the recorded instructions or other pertinent information, stored in the ROM 42, so that the user may hear the instructions or pertinent information.

The rear surface 60 of the informational member 58 may be mounted and secured to a supporting surface, as mentioned previously. Mounting means 68 for securing the informational member 58 to the supporting surface, such as a refrigerator or wall, may include one or more magnets, Velcro™ hook and loop fastening material, adhesive tape or any other well known mounting means.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

What is claimed is:

1. An auto-injection device holder, which comprises:

a main body, the main body including a front wall, a back wall disposed opposite the front wall, and a bottom wall, the front wall and the back wall together defining a top opening, the front wall, back wall and bottom wall together defining a cavity for receiving therein through the top opening at least one auto-injection device;

wherein at least one wall of the main body has formed therein an information sheet receiving slot; and wherein the holder further comprises:

a first information sheet, the first information sheet being mounted in the information sheet receiving slot, the first information sheet having indicia printed thereon relating to the months of a calendar year; and an indicator piece, the indicator piece being slideably mounted on the main body in alignment with the information sheet receiving slot and in proximity to the first information sheet, the indicator piece being generally rectangular in shape and including first and second spaced apart, parallelly disposed bars, the first and second bars defining between them a viewing window, the indicator piece being positionable with respect to the information sheet receiving slot such that the viewing window may be situated in alignment with selected indicia printed on the first information sheet.

2. An auto-injection device holder as defined by claim 1, wherein the main body further includes a separator wall situated in the cavity and disposed between the front wall and the back wall, the separator wall being provided to physically separate one auto-injection device received in the cavity from another auto-injection device received in the cavity.

3. An auto-injection device holder as defined by claim 1, wherein the main body further includes a top wall, the top wall extending between the front wall and the back wall and being situated opposite the bottom wall and in proximity to the top opening, the top wall having at least one opening formed through the thickness thereof for receiving therein the at least one auto-injection device.

4. An auto-injection device holder as defined by claim 1, wherein the front wall of the main body includes a first recessed portion; and wherein the holder further comprises a second information sheet, the second information sheet being mounted within the first recessed portion.

5. An auto-injection device holder as defined by claim 1, which further comprises:

mounting means for mounting the holder to a supporting surface, the mounting means being situated on the back wall of the main body.

6. An auto-injection device holder as defined by claim 1, which further comprises:

an electrical circuit, the electrical circuit being mounted to the main body, the electrical circuit providing information to a user of the holder.

7. An auto-injection device holder as defined by claim 6, wherein the electrical circuit includes a speaker, a switch mounted on a wall of the main body and exposed thereon so as to be activatable by a user of the holder, a read only memory, the read only memory having the information stored digitally therein, a microprocessor, the microprocessor being electrically coupled to the read only memory, the switch and the speaker, and a power source, the power source being electrically coupled to the microprocessor.

8. An auto-injection device holder as defined by claim 1, wherein the main body further includes an extended portion of the back wall, the extended portion having at least one opening formed through the thickness thereof for mounting the holder to a supporting surface.

* * * * *